United States Patent [19]

Hebel, Jr. et al.

[11] Patent Number: 4,968,359

[45] Date of Patent: Nov. 6, 1990

[54] STRESS RELIEF OF METALS

[75] Inventors: August G. Hebel, Jr., Farmington Hills; August G. Hebel, III, Troy, both of Mich.

[73] Assignee: Bonal Technologies, Inc., Detroit, Mich.

[21] Appl. No.: 393,261

[22] Filed: Aug. 14, 1989

[51] Int. Cl.[5] ..... C21D 1/04

[52] U.S. Cl. ..... 148/12.9; 73/579

[58] Field of Search ..... 148/12.9, 1, 4; 73/579

[56] References Cited

U.S. PATENT DOCUMENTS

| | | | |
|---|---|---|---|
| 2,848,755 | 8/1958 | Ettenreich | 148/12.9 |
| 3,622,404 | 11/1971 | Thompson | 148/12.9 |
| 3,677,831 | 5/1972 | Pezaris et al. | 148/12.9 |
| 3,741,820 | 6/1973 | Hebel, Jr. et al. | 148/12.9 |
| 3,786,448 | 8/1973 | Hebel, Jr. et al. | 148/12.9 |
| 4,381,673 | 5/1983 | Klauba et al. | 148/12.9 |
| 4,386,727 | 6/1983 | Unde | 228/102 |
| 4,446,733 | 5/1984 | Okubo | 73/579 |
| 4,718,473 | 1/1988 | Musschoot | 148/12.9 |
| 4,823,599 | 4/1989 | Schneider | 148/12.9 |

OTHER PUBLICATIONS

Thomas Hebel, A Better Way to Relieve Stress, *American Machinist*, Dec. 1986.

*Primary Examiner*—S. Kastler

*Attorney, Agent, or Firm*—Barnes, Kisselle, Raisch, Choate, Whittemore & Hulbert

[57] ABSTRACT

A method of stress relieving metal parts that includes the steps of applying mechanical cyclic vibration energy to a part over a test frequency range while monitoring the damping effects of energy flowing into the part as a function of frequency. A plurality of orders of harmonic vibration absorption peaks are identified, each consisting of a plurality of vibration absorption resonant peaks, employing a vibration transducer having a response that is dampened to distinguish the harmonic peaks from the resonant peaks. A sub-harmonic stress relief frequency is identified as a function of such frequency response and the composition of the part in question, and mechanical cyclic vibration energy is applied to the part for an extended time period at the sub-harmonic frequency so identified.

8 Claims, 1 Drawing Sheet

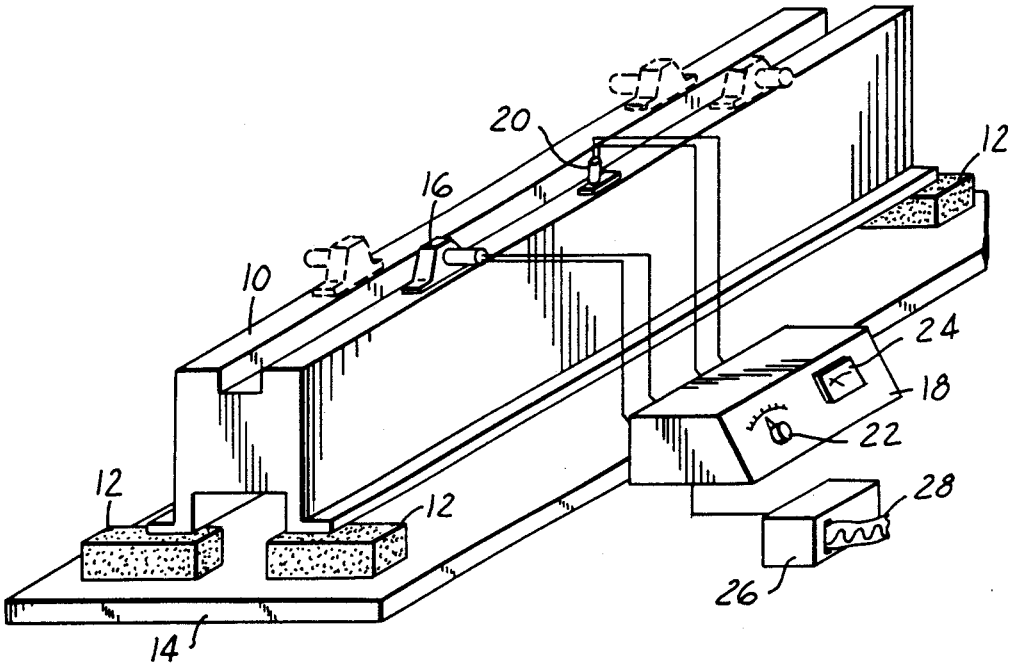
FIG. 1
FIG. 2
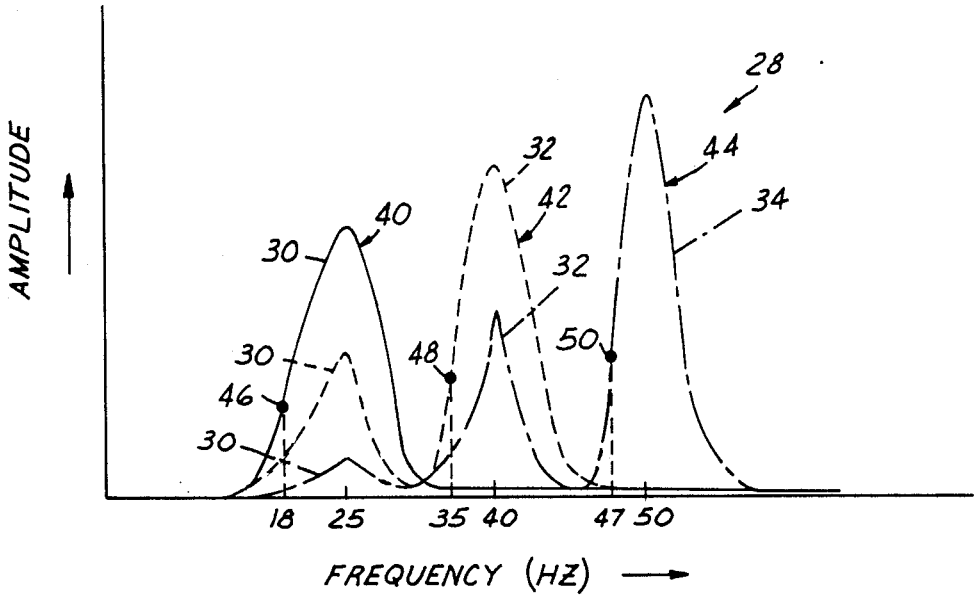

STRESS RELIEF OF METALS

The present invention is directed to stress relief of metal parts, and more particularly to an improvement in the stress relief process disclosed in applicants' prior U.S. Pat. No. 3,741,820.

As disclosed in applicants' prior patent noted above, residual stress relief in metal parts, such as weldments, may be accomplished by applying mechanical cyclic vibration energy to the part for an extended time duration at a fixed sub-resonant frequency corresponding to a mechanical vibration resonant frequency of the part. The sub-resonant frequency is identified by applying mechanical cyclic vibration energy to the part over a frequency range, and monitoring damping of energy flowing into the part as a function of frequency to identify a plurality of vibration absorption resonant peaks. The sub-resonant stress relief frequency is selected to lie along the low-frequency shoulder of one of the resonant peaks Although the process disclosed in the noted patent has enjoyed substantial commercial acceptance and success, improvements remain desirable. It is a general object of the present invention to provide a method of the described character for stress relieving metal parts that features an improved technique for selection of the stress-relief vibration frequency, and thereby obtains more efficient stress-relief in the metal part than has heretofore been obtained in accordance with the prior art discussed above.

Briefly stated, in accordance with the present invention, the stress-relief technique disclosed in the noted patent is improved and refined by applying mechanical cyclic vibration energy to the metal part over a test frequency range and monitoring damping effects of energy flowing into the part as a function of frequency to identify a plurality of orders of harmonic vibration absorption peaks, each consisting of a plurality of vibration absorption resonant peaks. A typical metal part may display up to forty-eight resonant peaks grouped into eight orders of harmonics, each consisting of approximately six resonant peaks. Harmonic vibration absorption peaks are distinguished from resonant vibration absorption peaks in accordance with a critical feature of the invention by appropriately damping the response characteristics of the vibration transducer coupled to the metal parts such that the electrical output thereof varies as a function of harmonic groups of resonant peaks rather than the resonant peaks themselves.

As a next step in implementation of the invention, a specific harmonic peak is selected from among the three lowest orders of harmonics as a function of composition of the metal part to be stress relieved. For example, the first order of harmonics, centered at approximately twenty-five hertz, has been found to be particularly advantageous for stress relief of low-carbon steels and cast iron. The second order of harmonics centered at about forty hertz has been found to be particularly advantageous for high-carbon steels, whereas the third order of harmonics centered at about fifty hertz has been found to particularly advantageous in conjunction with aluminum, titanium or copper alloys. A specific sub-harmonic stress relief frequency is then identified along the leading slope or shoulder of the selected harmonic peak, preferably at a frequency corresponding to a harmonic vibration amplitude equal to one third of the peak amplitude of the selected harmonic peak. Mechanical cyclic vibration energy is then applied to the part for an extended time duration at the sub-harmonic stress relief frequency so identified.

It has been found that stress relief in accordance with the present invention may be implemented on a wide variety of metal alloys, both soft and hard alloys, and at processing stages at which the alloys are either hot or cold. Further, stress relief may be implemented in accordance with the invention either during or after welding. Cyclic vibration energy applied at the sub-harmonic stress relief frequency allows dynamic kinetic energy to flow into the metal when the frequency of cyclic vibration is applied with a low steady stable constant level. Cyclic vibration is a dynamic loading and unloading mechanism that uses the mass-spring relationship found in metal alloys. Compliance of the yield modulus (stiffness) represents the amount of critical (tensile) residual stress retained in the metal structure. When cold mechanical cyclic energy is applied at the sub-harmonic frequency in accordance with the present invention, it redistributes or transforms the unwanted residual stress from weakness to strength. A time soak of low harmonic energy (typically under two hours) provides metal relaxation similar to that gained from two to three years of outdoor aging.

The invention, together with additional objects, features and advantages thereof, will be best understood from the following description, the appended claims and the accompanying drawing in which:

FIG. 1 is a perspective view showing apparatus for stress relieving a metal beam in accordance with the method of the present invention; and FIG. 2 is a graph showing three lower-order harmonic peaks and associated stress-relief frequencies in accordance with an exemplary implementation of the invention.

The disclosures of U.S. Pat. Nos. 3,736,448 and 3,741,820 are incorporated herein by reference.

FIG. 1 illustrates implementation of the invention for stress relieving a beam 10. The beam is mounted on a plurality of vibration cushions 12 distributed around a support 14. A vibrator 16, which preferably comprises a variable speed eccentric motor, is mounted on beam 10 and coupled to a control electronics package 18. A vibration transducer 20 is likewise mounted on beam 10 and provides an electrical output to package 18 as a function of amplitude of beam vibration. Package 18 includes a knob or other suitable control means 22 for selectively varying frequency of vibration applied to beam 10 by motor 16, a gauge or other suitable readout 24 for indicating frequency of vibration to an operator, and an output coupled to a recorder 26 for providing on X-Y plotter 28 having the frequency response characteristics of beam 10 recorded thereon FIG. 2 illustrates the frequency response characteristic of beam 10—i.e., plots 28 of vibration amplitude versus frequency—on three scans 40, 42, 44 at three differing recorder sensitivities. At a first sensitivity setting, a first order of harmonics displays a peak 30 centered at approximately twenty-five hertz. At a lower sensitivity setting, the recorded amplitude of peak 30 is correspondingly reduced, and a second peak 32 is observed at a higher second order of harmonics centered at a frequency of approximately forty hertz. Likewise, further sensitivity reduction results in a further decrease in amplitude of peak 30, a decrease in amplitude of peak 32, and recording of a third order of harmonics at peak 34 centered at a frequency of about fifty hertz. Each peak 30–34 includes a plurality of resonant peaks of higher frequency content. Harmonic peaks 30–34 are distinguished from the resonant peaks by appropriately damping the response characteristics of vibration transducer 20, either at the transducer structure or at the transducer-responsive electronics. In a presently preferred implementation of the invention, transducer 20 takes the form disclosed in U.S. Pat. No. 3,736,448, in which the mechanical structure is such as inherently to dampen the response characteristics thereof so as to be responsive to the harmonic peaks while ignoring the resonant peaks.

For identification of an appropriate stress relief frequency, a particular harmonic peak 30–34 is employed as a function of composition of beam 10. For example, it has been found that the first order of harmonics, corresponding to peak 30, may be advantageously employed for low-carbon steels and cast iron. The second order of harmonics illustrated at peak 32 may be advantageously employed for high carbon steels, whereas the third order of harmonics illustrated at peak 34 may be advantageously employed for aluminum, titanium or copper alloys. For identifying the appropriate stress relief frequency, the scan 40, 42, 44 is employed that shows the peak of interest at greatest sensitivity. For example, for low-carbon steels, scan 40 would be employed showing peak 30 at greatest sensitivity.

A specific sub-harmonic stress relief frequency is identified as the frequency in plot 28 associated with a vibration amplitude at the selected harmonic peak equal to one-third of the maximum amplitude of that peak as compared with the amplitude at the beginning of the harmonic slope. That is, the one-third amplitude point is not found with reference to zero at the beginning of the harmonic slope. Thus, in the plot 28 of FIG. 2, a sub-harmonic stress relief frequency of approximately eighteen hertz would be associated with the point 46 at one-third of the amplitude of peak 30. At scan 42, a sub-harmonic stress relief frequency of approximately thirty-five hertz would be associated with the point 48 at approximately one-third of the maximum amplitude of peak 32, and a stress relief frequency of approximately forty-seven hertz would be associated with the point 50 at one-third of the maximum amplitude of peak 34.

It will be appreciated that, whereas the locations of the harmonic peaks remain substantially at twenty-five, forty and fifty hertz for all metals and alloys, the widths and slopes of the peaks vary with alloy and/or geometry, so that the subharmonic stress relief frequency for two cast iron structures of differing geometries, for example, would not necessarily be the same. The one-third set point has been found to be optimum. At less than one-third, stress relief takes place, but more dwell time is required. Likewise, at a point between one-third and two-thirds of the peak amplitude, stress relief takes place, but dwell time is increased. Settings at more than two-third of the harmonic peak do not work well. When stress relieving during welding or casting, the optimum stress relief frequency changes as the alloy hardens and/or more weld is applied. The one-third set point should be monitored and adjusted to follow changes in harmonic frequency conditions.

Following identification of the optimum sub-harmonic stress relief frequency for the particular structure and alloy in question in accordance with the previous discussion, motor 16 is then energized at the frequency so identified for an extended time duration, such as on the order of two hours, to accomplish stress relief in the metal part. For large parts, such as beam 10, motor 16 may have to be relocated a number of times, as indicated in phantom in FIG. 1, for optimum results.

We feel that theoretically the application of Sub Harmonic Vibration to any material which, when two pieces of material are joined by the application of a liquid material which solidifies and creates a bond between the two original components, will benefit the bond with a stronger more ductile union. The only variation will be the energy force of vibration and the harmonic frequency locations.

The invention claimed is:

1. A method of stress relieving metal objects comprising the steps of:
   (a) applying mechanical cyclic vibration energy to a said object over a test frequency range,
   (b) monitoring damping effects of energy flowing into the object as a function of frequency and identifying a plurality of orders of harmonic vibration absorption peaks, each consisting of a plurality of vibration absorption resonant peaks, and then
   (c) applying mechanical cyclic vibration energy to the object for an extended period of time at fixed frequency corresponding to a sub-harmonic frequency of one of said harmonic peaks.

2. The method set forth in claim 1 wherein said step (b) comprises the steps of:
   (b1) mounting a vibration transducer on the object to provide an electrical output signal as a function of vibration amplitude, and
   (b2) damping response of said transducer to mechanical vibration such that said output varies as a function of harmonic groups of vibration resonant peaks.

3. The method set forth in claim 1 comprising the additional step, prior to said step (c), of:
   (d) selecting said fixed frequency as a function of composition of the object.

4. The method set forth in claim 3 wherein said step (d) comprises the steps of:
   (d1) selecting a particular order of harmonics from among said plurality of orders as a function of composition of the object, and
   (d2) identifying a sub-harmonic frequency associated with said particular order of harmonics and corresponding to a vibration amplitude equal to approximately one-third of maximum vibration amplitude of said particular order, and wherein said step (c) comprises the step of applying said mechanical cyclic vibration energy to the object at said sub-harmonic frequency identified in said step (d2).

5. A method of stress relieving a metal part comprising the steps of:
   (a) applying mechanical cyclic vibration energy to the part over a test frequency range,
   (b) monitoring damping effects of energy flowing into the part as a function of frequency by mounting a vibration transducer on the part to provide an electrical output signal as a function of vibration amplitude and damping response of said transducer to mechanical vibrations such that said output varies as a function of harmonic groups of vibration resonant peaks,
   (c) identifying at least one peak of harmonic vibration absorption consisting of a plurality of vibration absorption resonant peaks, and then (d) applying mechanical cyclic vibration energy to the part for an extended period of time at fixed frequency corresponding to a sub-harmonic frequency of said at least one harmonic peak.

6. The method set forth in claim 5 wherein said step (d) comprises the step of: selecting said sub-harmonic frequency as that at which vibration amplitude at said peak is equal to one-third of maximum vibration amplitude at said peak.

7. The method set forth in claim 6 wherein said step (c) comprises the step of (cl) identifying a plurality of said harmonic vibration absorption peaks, and (c2) selecting said one peak as a function of composition of the part.

8. The method set forth in claim 7 comprising the additional steps of:

(e) monitoring said damping effects as set forth in step (b) while applying said energy as set forth in step (d).

(f) identifying any changes in harmonic frequency of said one peak, and (g) reselecting said one peak as set forth in step (d) as a function of said changes identified in step (f).

* * * * *